US005664388A

United States Patent [19]

Chapman et al.

[11] Patent Number: 5,664,388

[45] Date of Patent: Sep. 9, 1997

[54] STRUCTURAL SHEAR RESISTING MEMBER AND METHOD EMPLOYED THEREIN

[75] Inventors: Larry Thomas Chapman, Potrero; Kenneth R. Bass, deceased, late of El Cajon, both of Calif., by Donna R. Bass, executor

[73] Assignee: Donna Bass, El Cajon, Calif.

[21] Appl. No.: 556,894

[22] Filed: Nov. 3, 1995

Related U.S. Application Data

[63] Continuation-in-part of Ser. No. 413,544, Mar. 30, 1995, which is a continuation-in-part of Ser. No. 190,643, Feb. 2, 1994, Pat. No. 5,499,480, which is a continuation-in-part of Ser. No. 82,989, Jun. 25, 1993, abandoned, which is a continuation-in-part of Ser. No. 40,494, Mar. 31, 1993, abandoned.

[51] Int. Cl.[6] ..... E04B 1/08

[52] U.S. Cl. ..... 52/653.1; 52/262; 52/270; 52/481.1; 52/481.2; 52/482; 52/514; 52/633; 52/653.2; 52/657; 52/664; 52/695; 52/745.1; 52/745.12; 52/745.13; 52/745.2

[58] Field of Search ..... 52/745.1, 745.12, 52/745.13, 745.2, 514, 762, 764, 581, 799.11, 657, 664, 634, 633, 262, 263, 271, 481.1, 653.1, 690, 270, 481.2, 482, 653.2, 695; 403/201, 290, 363, 403

[56] References Cited

U.S. PATENT DOCUMENTS 1,331,247 2/1920 Daniels .
1,924,881 8/1933 Ragsdale .

(List continued on next page.)

FOREIGN PATENT DOCUMENTS 2330695 6/1994 Australia .
675888 2/1930 France .

(List continued on next page.)

OTHER PUBLICATIONS

*The Carpenter's Steel Stud*—Product Brochure—HL Stud Corporation—Mar., 1994.

(List continued on next page.)

*Primary Examiner*—Christopher T. Kent
*Attorney, Agent, or Firm*—Brown, Martin, Haller & McClain

[57] ABSTRACT

A shear resisting member of a frame structure comprising four triangular cross-section beams, each beam or stud formed from a single piece of cold formed sheet steel which is bent lengthwise along four parallel lines to form a triangular cross-section with two wings or flanges, side-by-side, extending from its apex. Within the frame structure of the shear resisting member, two frame beams have first beam lengths corresponding to the longer dimension of the opening in the wall to be reinforced, which are disposed parallel to each other. The other two beams have second beam lengths substantially shorter than the first beam lengths, the second beam length corresponding to the spacing between the frame studs or truss members of the structure being reinforced. Gussets are attached along the lengths of the wings or flanges of the second beams and the ends of the first beams to fasten the frame structure together. A plurality of strut members span the interior edges of the first beams to form an open web between the two first beams. The strut members, each formed from sheet steel folded or creased to form triangular cross-sections, are fastened to the first beams at angles to provide shear resistance in a plurality of different directions. A method for retrofitting existing structures to provide reinforcement against shear forces comprises identification of weight-bearing walls and removal of interior wall paneling, such as dry wall, to expose the frame along sections of the wall. A shear panel is selected to have horizontal dimensions to fit between two adjacent wall studs, and vertical dimensions to extend from the foundation or floor joist to the roof truss or floor joist of an upper story for multi-level structures. The original wall studs are removed and the panel is inserted along with replacement wall studs.

28 Claims, 6 Drawing Sheets

U.S. PATENT DOCUMENTS

| | | |
|---|---|---|
| 2,029,645 | 2/1936 | Waugh . |
| 2,098,752 | 11/1937 | Miller . |
| 2,167,835 | 8/1939 | Greulich . |
| 2,457,250 | 12/1948 | Macomber . |
| 2,611,160 | 6/1952 | Hanesse . |
| 3,129,493 | 4/1964 | Grubb . |
| 3,221,467 | 12/1965 | Henkels . |
| 3,541,749 | 11/1970 | Troutner . |
| 4,069,638 | 1/1978 | Hasselqvist et al. . |
| 4,168,596 | 9/1979 | Yoder, Jr. . |
| 4,196,556 | 4/1980 | Russo . |
| 4,253,224 | 3/1981 | Hickman et al. . |
| 4,597,118 | 7/1986 | Mis . |
| 5,150,982 | 9/1992 | Gilb . |

FOREIGN PATENT DOCUMENTS

| | | |
|---|---|---|
| 2063545 | 7/1971 | France . |
| 2269618 | 11/1975 | France . |
| 4023902 | 2/1992 | Germany . |
| 8901549 | 2/1989 | WIPO . |
| 9117328 | 11/1991 | WIPO . |

OTHER PUBLICATIONS

Marketing Materials from Concise Drafting Service, including diagrams and photos of PT Brace Wind Bracing Panel Apr. 29, 1996.

STRUCTURAL SHEAR RESISTING MEMBER AND METHOD EMPLOYED THEREIN

This is a continuation-in-part of application Ser. No. 08/413,544, filed Mar. 30, 1995, which is a continuation-in-part of application Ser. No. 08/190,643, filed Feb. 2, 1994, now issued as U.S. Pat. No. 5,499,480, which is a continuation-in-part of application Ser. No. 08/082,989 filed Jun. 25, 1993, which is a continuation-in-part of application Ser. No. 08/040,494, filed Mar. 31, 1993, now abandoned.

BACKGROUND OF THE INVENTION

In recent years, metal construction materials have become recognized as practical and economical option for traditional lumber construction for residential and light commercial structures. Interest in metal construction materials has been elicited by drastically increased costs of lumber and by the significant losses of life and property that have occurred during earthquakes and other natural disasters in which shearing forces severely damaged wood framed structures, causing the buildings to collapse.

While new construction is subject to updated regulations which are designed to make the structures better able to withstand shear forces, this does not address the issue of countless older houses, apartment buildings and other buildings that are still in use. With many of the structures, retrofitting to enhance shear resistance can be as complex and expensive as rebuilding. Further, if this expense is undertaken, the reinforcement may add strength to the wall only, and not the overall structure as is necessary to prevent collapse under intense, repeated shear conditions.

Conventional means for shear reinforcement consist of "diaphragming" the frame structure. This process involves removal of both existing interior and exterior surfaces and attachment of a solid sheet of material on each side, typically plywood in wood frame construction, to wall studs, nailing the plywood to the wall studs around the plywood sheet's perimeter at spacings dictated by well-known engineering standards. This method relies upon the structure's frame alone for support, and provides no means for enhancing shear resistance by attaching the shear panel independently to the structure's foundation. This provides limited shear resistance which, during the repeated exposure to shearing forces such as might occur during aftershocks of a major earthquake, stresses the nails and plywood to their own material limits, shearing off the nails and splintering the plywood. Since the shear panels are not attached to the foundation, there is no resistance to uplift or lateral motion of the entire structure. Further, the specified shear resistance requires modification of large areas of the wall to attach a sufficient amount of plywood to provide the required reinforcement, which can be expensive and highly disruptive considering the fact that both the exterior and interior surfaces must be removed and replaced.

Methods have been proposed for creating an I-beam-like structure with the heads of the beam abutting the wall studs and the web of the beam spanning the space between the studs. However, this has similar disadvantages to the plywood panel except that the web buckles or folds under shear pressure instead of splintering. Further, there is an added issue of uninterrupted thermal conductivity across the entire panel, which has a negative impact on the structure's insulation.

An alternative means for adding shear resistance is X-bracing, in which two steel beams are attached diagonally from the foundation to the truss upper joist. These are applied to the exterior of the wall only, which, nonetheless, can be highly disruptive, interfering with the building's weather resistant qualities, and requiring removal and replacement of detailed decorative exterior finishes.

A lumber-compatible lightweight metal construction system has been disclosed in grandparent application Ser. No. 08/190,643 of Bass, which has been allowed, which is incorporated in its entirety by reference. This metal construction system is based upon a triangle-cross-sectioned beam with flanges extending from the triangle's apex. The beam's openable configuration allows it to be easily connected to other beams and other construction materials, including framing lumber and paneling. A significant advantage of this metal construction system is that adjacent lengths of triangular beams are connected only at relatively small portions of the beams' overall lengths, so that thermal conduction is minimized from one beam to another. This represents a significant improvement over prior art metal construction systems, which suffered from, among other things, problems relating to the inability to effectively insulate walls framed with metal beams to compete with the energy efficiency of wood-framed construction. The metal construction system of Bass further permitted placement of insulation within the spacing to construct structures with insulation "R" values rivaling those for wood frame construction.

It would be desirable to provide an apparatus for providing improved shear resistance which can be incorporated both in new and existing structures, which apparatus can be easily constructed and installed on the interior sides of the structure's walls with minimal disruption; it would also be desirable to provide a method for retrofitting existing structures to increase shear resistance.

SUMMARY OF THE INVENTION

It is an advantage of the present invention to provide a means for increasing shear resistance in a structure having a frame-based construction.

It is a further advantage of the present invention to provide a method and a means for retrofitting an existing structure with interior shear resistance means.

Still another advantage is to provide a method for adding shear resistance to a structure which can be performed entirely from inside the structure, with minimal disruption.

In an exemplary embodiment, a shear resisting member of a frame structure comprising four triangular cross-section beams, each beam or stud formed from a single piece of cold formed sheet steel which is bent lengthwise along four parallel lines to form a triangular cross-section with two wings or flanges, side-by-side, extending from its apex. The two flanges are not attached together by a separate fastening means, but remain separable until the beam is joined to another beam or other type of construction material. This feature means that the beam or stud itself can become part of the connection by creating a sandwich with a connector between two beam sections. Alternatively, the outer surfaces of the flanges of the beams can be sandwiched between a two-ply connection. This sandwiching technique creates a much stronger joint as well as facilitating assembly. (Note that the terms "beam" and "stud" may be used interchangeably. This is intended only as an indication that the beam can be used as either a stud (vertically-oriented frame component or a truss-member (horizontally-oriented frame component).)

Within the frame structure of the shear resisting member, two frame beams have first beam lengths corresponding to the longer dimension of the opening in the wall to be reinforced, which are disposed parallel to each other. The other two beams have second beam lengths substantially shorter than the first beam lengths, the second beam length corresponding to the spacing between the frame studs or truss members of the structure being reinforced.

Gussets are attached along the lengths of the wings or flanges of the second beams and the ends of the first beams to fasten the frame structure together. A plurality of strut members span the interior edge of the first beams to form an open web between the two first beams. The strut members, each formed from sheet steel folded or creased to form triangular cross-sections, are fastened to the first beams at angles to provide shear resistance in a plurality of different directions.

In a first embodiment, the shear resisting member is a panel disposed in a vertical orientation for fitting between studs in a structural frame, where the studs are spaced apart at an industry-standard spacing. The first beams of the frame structure are each fastened to a metal stud which may be a conventional C-channel beam or may be two triangular cross-section tubes spanned by an open web consisting of a plurality of gussets. With either beam, the ends, which would correspond to the 2 inch side of a 2×4 framing stud, are modified to create tabs extending from the ends of the beam to permit attachment of the metal stud to horizontal truss members and to the foundation or horizontal floor joists. Triangular hold-down braces are attached at the lower ends of the shear resisting panel to position the panel and studs in relation to the structure's foundation or base and to provide means for bolting the panel directly to the foundation.

Where the first embodiment is installed in an existing structure as a retrofit, the metal studs, which are already fastened to the sides of the shear panel, can be used to replace the existing wood or metal studs with the studs being attached to the foundation and horizontal truss member. For new structures, the metal studs are appropriately positioned to fit within the desired frame dimensions as part of the original frame construction.

In a second embodiment, the shear resisting member is disposed in a horizontal orientation for floor and roof trusses and for door and window headers. The panel of the second embodiment has dimensions to closely fit within an opening defined by the vertical and horizontal frame sections.

A method for retrofitting existing structures to provide reinforcement against shear forces comprises identification of weight-bearing walls and removal of interior wall paneling, such as dry wall, to expose the frame along sections of the wall. Identification of weight-bearing walls and critical support sections therein are within the level of skill in the construction art, and, therefore, are not described. A shear panel is selected to have horizontal dimensions to fit between two adjacent wall studs, and vertical dimensions to extend from the foundation or floor joist to the roof truss or floor joist of an upper story for multi-level structures. The original wall studs are removed and the panel is inserted along with replacement wall studs which are then firmly attached at their tops and bottoms to the horizontal members of the frame, and to the foundation by way of long bolts extending from the hold down brackets attached to the panel.

Due to the open nature of the shear panel, after fastening to the frame, insulation may be replaced within the spacing. Since the original frame is unchanged, the dry wall or other paneling can be reattached in the same manner as it was before the retrofit, e.g., by nailing the panels to the studs and/or fascia.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which:

FIG. 6 is a perspective view of a beam section of a C-channel beam for attachment to a wood stud or the like;

FIG. 7 is a perspective view of a beam section for attachment to a wood stud or the like;

DESCRIPTION OF THE PREFERRED EMBODIMENT

Figure 1:
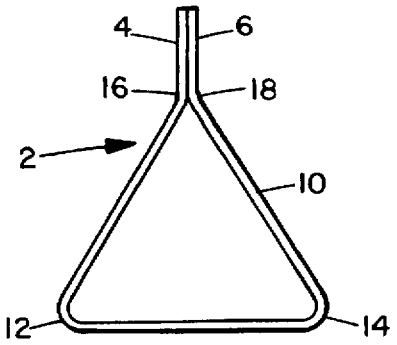
FIG. 1 is an end view of a lightweight steel beam which is the basis of the present invention.

As illustrated in FIG. 1, the basic lightweight steel beam or stud 2 is triangular in shape with a pair of flanges 4 and 6 extending from the apex 8 of the triangle 10. The triangle 10 is created by bending a sheet of cold formed steel at four places: bottom corners 12 and 14 and shoulders 16 and 18 so that the edges of flanges 4 and 6 are generally even. The triangle 10 is symmetrical around a line drawn from the apex 8 perpendicular to the base. The bottom corners 12 and 14 are slightly rounded to avoid weakening the metal at the bends. No welding or other fastening operation is performed on the stud 2, so the flanges 4 and 6 remain unattached until a structure is assembled. The flanges facilitate attachment of the beams to the various connectors described below and are not intended to act as webs as in a conventional I-beam. Therefore, typically, the flanges need only be wide enough to support fasteners driven therethrough, or wide enough to prove sufficient surface area for a strong weld, and will be shorter than the heights of the sides of the triangle. Holes may be pre-drilled in the beam to facilitate insertion of fasteners for connecting beams together.

The width of the base of triangle 10 of a beam is comparable to that of a two-by-four stud, so that anything that would have required support from the edge of a stud, such as wallboard, plywood or roofing material, will be similarly supported by the beam 2. Similarly, where specialized connectors are described above for use with wood studs, the inventive beams may be substituted for the stud. Nails or other fasteners may be driven through any side of the triangle 3 to attach material which is to be supported. Other building materials may also be inserted between the flanges 4 and 6 and into a beam. For example, a two-by-four stud can be inserted by spreading the triangle to provide a wood surface for nails. Similarly, plastics or composite building materials may also inserted into the beams. Where appropriate, different size beams can be used which are larger than or smaller than the dimensions of a typical 2×4.

Figure 2:
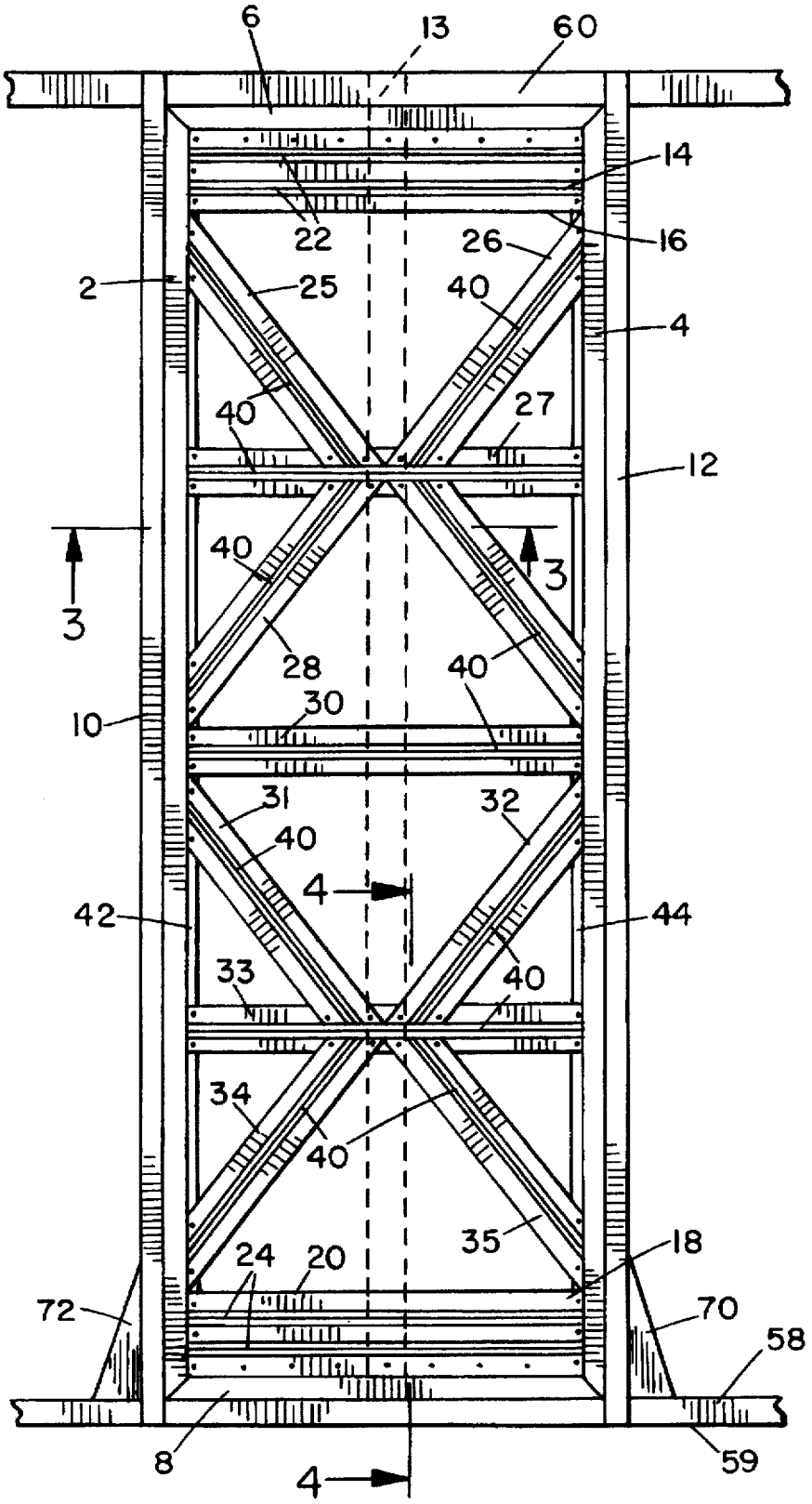
FIG. 2 is a diagrammatic view of a first embodiment of the shear resisting panel.
Figure 4:
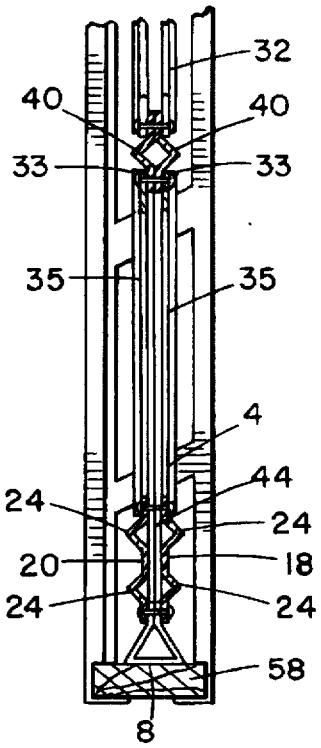
FIG. 4 is a cross-sectional view taken along line 4—4 of FIG. 2.
Figure 3:
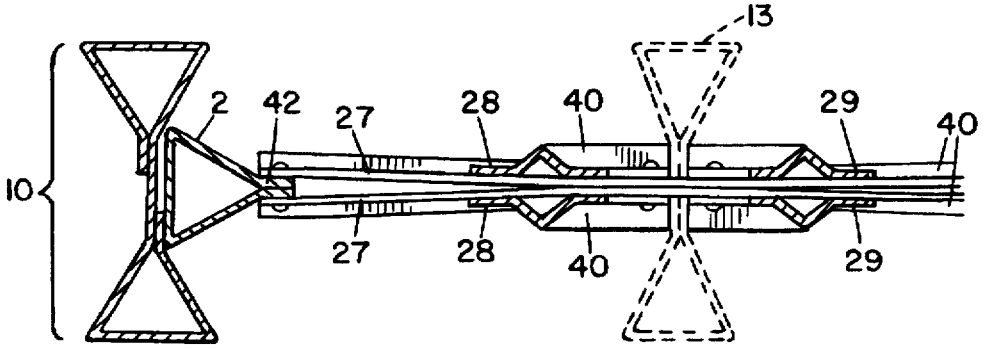
FIG. 3 is a cross-sectional view taken along line 3—3 of FIG. 2.

A first embodiment of the shear resisting member is illustrated in FIGS. 2–4, in which the frame structure comprising first frame beams 2, 4, having first lengths corresponding to the height of the wall to be reinforced, and second frame beams 6, 8 having lengths corresponding to the spacing between vertical wall studs 10, 12 so that the shear resisting panel will fit within the standard spacing in the wall frame.

The first frame beams 2, 4 are attached to second frame beam 8 to form right angles at the lower end of the panel to conform to the lower support surface, which is the foundation or floor joist. The upper second frame beam 6 may be attached to the first frame beams 2,4 at right angles or at any angle necessary to conform to the angle of the upper truss member to which it will be attached. If the location at which the shear panel is to be installed corresponds to peaked ceiling, the frame will have five beams, with two second beam sections at the top of the panel. The ends of each of the first and second frame beams are angle cut at approximately 45° to form the corner joints for a 90° corner. For a corner having an angle other than 90°, the ends of the frame beams are cut at an appropriate angle to provide the desired external angle. Gussets 14, 16, 18, and 20 are fastened to the flanges of the first and second beams. As illustrated, the gussets are attached to the outside surfaces of the flanges, however, the gussets may be flat plates of sheet metal inserted in between the respective beams' flanges. For externally attached gussets, it is preferred that gussets be attached on both sides of the flanges, to create a sandwich. Semi-triangular ridges 22, 24, or corrugations, may be formed in gussets 14, 16, 18, 20 by creasing or folding the sheet metal to provide additional shear resistance to prevent bending or buckling of the sheet metal. A combination of internal and external gussets may be used to further enhance the strength of the connection, with fasteners being applied through both beam flanges of each beam and all corresponding gussets. In the preferred embodiment, the fasteners a press joints, such as the Tog-L-Loc and Lance-N-Loc™, of BTM Corporation (see, e.g., U.S. Pat. No. 5,177,861).

Figure 5:
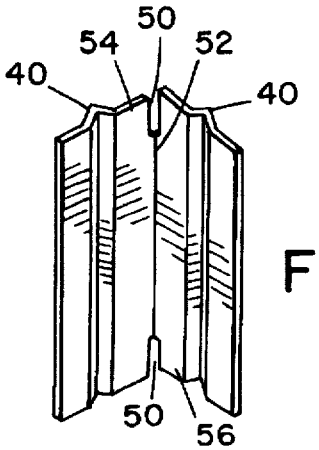
FIG. 5 is a perspective view of a strut section.

Struts 25–35 are formed in a manner similar to the ridged gussets, with a semi-triangular ridge 40 extending along the length of the sheet metal of which the strut is made. The ridge 40, formed by bending the sheet metal along three lines parallel to the longer edge of the sheet, as shown in FIG. 3, provides enhanced shear resistance within each strut. The struts 25–35 are fastened to the flanges 42, 44 of the first frame beams 2, 4 so that they span the space framed by the beams. The angles at which the struts are fastened are selected to provide multi-directional resistance to pressure applied along the lengths of first frame beams 2,4. For example, struts are placed at −45°, +45°, and 90° relative to the first beams. As with the gussets, it is preferred that struts be attached on both sides of the beam flanges 42, 44 as to create a four-ply sandwich consisting of strut-flange-flange-strut. This can be achieved by forming two separate strut sections, or by folding a strip of sheet metal in half along its length and cutting a slot 50 in along the fold 52 at each end 54, 56 of the strip, as illustrated in FIG. 5, to allow the ends to fit over both beam flanges, effectively forming two strut members. Fasteners are driven through the ends of both strut members and the beam flanges 42, 44.

The frame structure is retained between two studs 10, 12 which are spaced apart according to standard industry spacings (generally 16 inches in residential and light commercial construction or some multiple thereof). Bolts, screws, or other fasteners are used to affix the panel to studs 10, 12. The studs 10, 12 are attached at the bottom to the floor joist 58 and/or directly to the foundation 59, and at the top to the roof or ceiling truss member 60. Direct attachment to the foundation for a first story installation is provided by boring holes through floor joist 58 and into the foundation 59, and using one or more long bolts 75 to fasten the panel to the foundation. Above the ground floor in multi-story structures, the shear resisting member is attached at its lower end to the ceiling truss member of the lower story. The shear panel as illustrated in FIG. 2 is representative of a panel which would span two standard spacings or approximately 32 inches. In order to assure that a surface is provided for attachment of finishing panel such as drywall, a center fascia beam 13 may be provided centered between beams 10 and 12, as shown with dashed lines in FIG. 2. Although the fascia is positioned where a previous wall stud was present, the strength and shear resistance provided by the shear panel is sufficient, and the fascia is not intended to bear any weight and does not add any shear resistance to the shear panel.

Figure 11A:
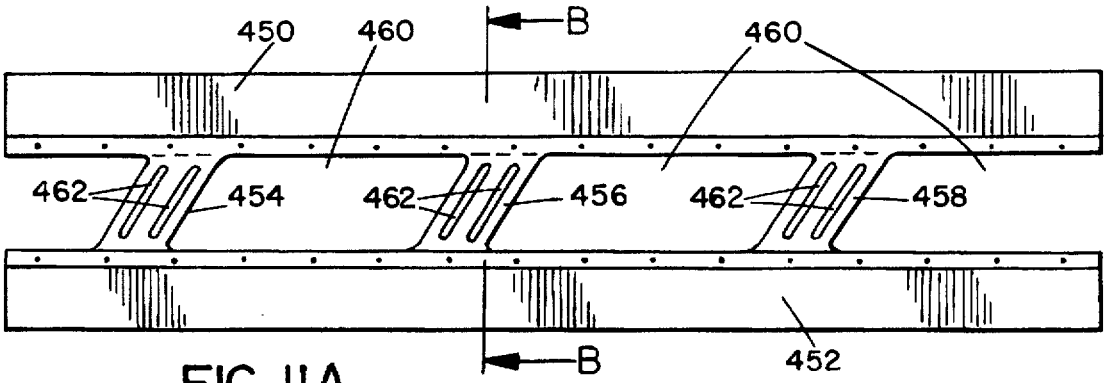
FIGS. 11*a* and *b* illustrate a unitary wall stud constructed using the inventive construction system, with FIG. 11*a* showing a side elevation and FIG. 11*b* showing a cross-section taken along line B—B of FIG. 11*a;*
Figure 11B:
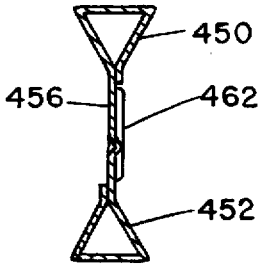

In the preferred embodiment, the two wall studs 10, 12, are of similar construction to the shear resisting member. Specifically, the stud, which is illustrated in more detail in FIGS. 11*a*, 11*b*, comprises two triangular cross-sections tubes 450, 452, and a plurality of gussets 454, 456, 458, which combine to form an open web beam, all of which are formed as a unit. Each stud 10, 12 is created from a single sheet of steel which is stamped to create cutouts between the gussets 454, 456, 458 and roll formed to fold the sheets lengthwise along eight parallel lines (four for each triangular section, in a manner similar to the basic beam described above.) The gusset members 454, 456, 458 are stamped to create ribs 462 which run parallel to the lengthwise edges of the gusset, providing reinforcement against shear forces. The gussets are shaped as a parallelogram so that they span the space between the beams at an angle while the ends 302, 304 of gussets are still parallel with the bases of tubes 450, 452. For additional strength, ribs may be formed in the gussets parallel to the edges which span the space between the beams being connected. The wings of the triangular beams are joined together using a press joint, weld, or other fastening means, preferably at 2–4 inch spacings along the length of the beams.

The gusset within the wall stud is not intended to be a substitute for the web of an I-beam, it is merely a connector.

The lack of continuous connection between two beams is important when considering insulation and thermal conduction in buildings constructed with metal or partly metal frames. Minimal thermal conduction occurs where there is minimal connection between two beams. The space between the beams is, itself, a good insulator. However, the availability of space allows the effective installation of insulation. Further, if the gusset is made of a non-thermally conductive material, conduction between the two beams is effectively eliminated. The wall stud is generally dimensioned so that can be substituted for a 2×4 wood stud to provide the inner and outer surfaces for mounting sheet material.

Figure 7:
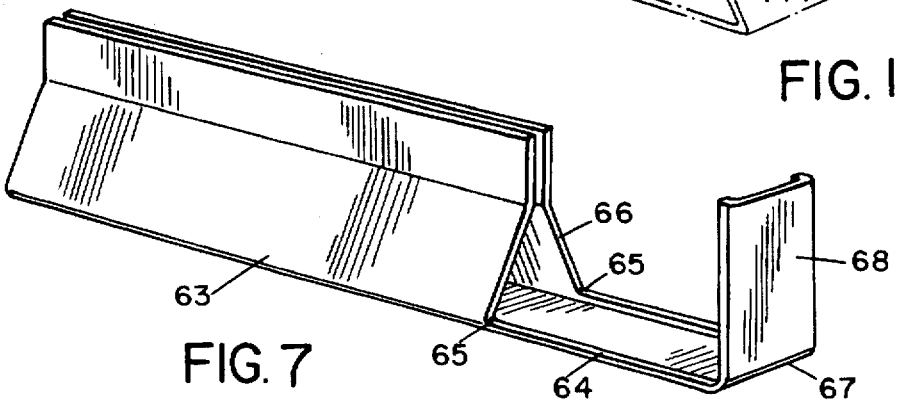

The preferred means for attaching the wall stud at the upper and lower ends to the horizontal members 58 and 60 are illustrated in FIGS. 7 and 10, which are described in more detail below.

As shown in FIG. 2, at the bases of the studs 10, 12, hold-down brackets 70, 72 are fastened by bolts, screws, rivets or other means to their outer sides to permit attachment to bolts or other fastening hardware connected to the foundation 59 or other support base. In the preferred embodiment, the bolts which pass through the bases of the hold-down brackets and into the foundation are on the order of one foot long. The hold-down brackets, which are commercially available, work in concert with the shear panel and to provide resistance to uplift, which could separate the structure from the foundation, as well as resistance to the lateral movement, when the structure shifts on the foundation. In a prototype structure, the hold down brackets used were designated as SHD-10, which are rated at 9500 lbs.

The wall studs between which the shear panel is retained need not be in the configuration described above, and the wall stud itself is not critical to the shear resisting function of the shear panel. Conventional C-channel beams may be substituted, and similar end joint tabs for fastening the beams to the horizontal members may be created from the C-channel beams by cutting in at the corners of the C-channel to define an extension tab which wraps around portions of the horizontal members and through which fasteners can be driven, as will described in more detail with regard to FIG. 6. Other materials may also be used for studs as long as they comply with construction code requirements where the horizontal members are metal beams, such as C-channel, end joints as described for attachment to 2×4 lumber truss members may be used, however, it may be preferred to utilize gusset/tab connectors as illustrated in FIGS. 8 and 9 due to the ease of assembly.

Figure 8:
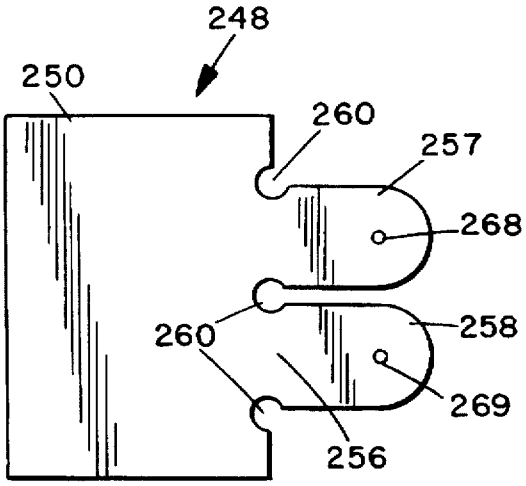
FIG. 8 is a top view of a gusset/tab connector.
Figure 9:
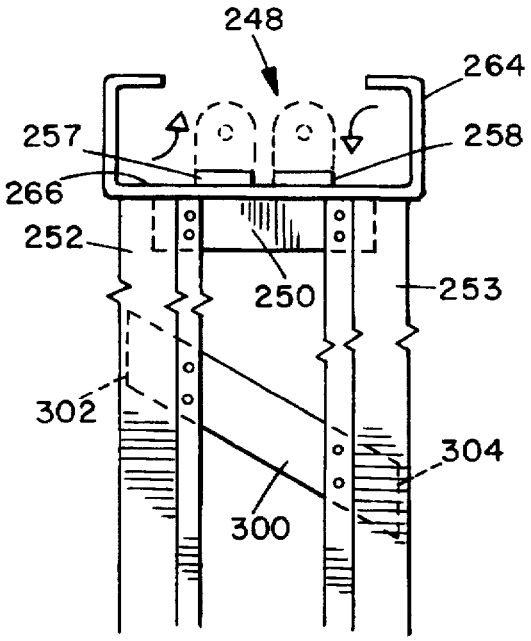
FIG. 9 is a perspective view of the gusset/tab connector of FIG. 8 connecting two beams.

The gusset/tab connector 248 for joining a first beam perpendicular to a second beam or other construction material, such as a C-shaped beam or sheet material, is illustrated in FIG. 8. The gusset/tab connector 248 is a flat piece of sheet steel which is cut with two or more tabs extending from one side. The first portion 250 has flat edges and is inserted between the wings of vertical beams 252, 253 shown in FIG. 9. Gusset/tab connector 248 may be attached to the vertical beams 252, 253 by welding or by suitable fasteners. The second portion 256 has tabs 257 and 258 formed therein. The tabs may be formed by stamping or cutting the sheet metal. Notches 260 are provided to facilitate bending of the tabs.

Tabs 257, 258 are inserted through a slot 262 in a horizontal beam 264 so that first portion 250 is on a first or outer side of the horizontal beam and the tabs are on the second or inner side. As illustrated, the horizontal beam 264 is a C-channel beam. The tabs 257, 258 are bent in opposite directions, so that each is perpendicular to the first portion 250 and flush with the inner surface 266 of beam 264. Only one, or more than two tabs can also be used to create such a connection. Where there are multiple tabs, the adjacent tabs may be bent in opposite directions. The tabs may be welded to inner surface 266, or fasteners may be driven through pre-cut holes 268, 269.

It should be noted that, while the first embodiment of the shear panel is described in its application in a vertical orientation, the shear panel can also be used in a horizontal orientation, such as is illustrated in FIG. 17, for use in floor and roof trusses, and as door and window headers. The construction of the horizontally oriented shear panel is similar to that of the first embodiment, however, since it is narrower in width (second beam length), the struts do not form a cross pattern, but only display a sawtooth pattern. In both embodiments, placement and angles of the struts is determined by standard shear resistant criteria and will be apparent to those skilled in the art. As is known in the art, if the length of the shear panel is such that an integral number of required open web components can be used to provide the required degree and uniformity of shear resistance, chases, or struts perpendicular to the first beams, can be used.

Figure 12:
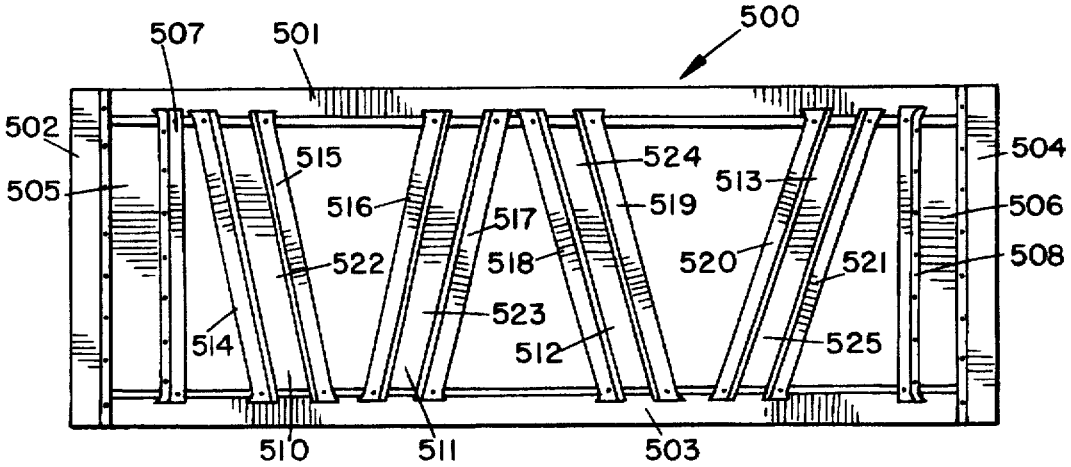
FIG. 12 is a shear panel constructed according to the inventive system.

The second embodiment of the shear resisting panel is illustrated in FIG. 12. The shear panel 500 is constructed using the beams, studs and connectors as disclosed below. Beams 501–504 form the outer frame of the panel as described for the first embodiment, with first beams 501, 503 being longer than second beams 502, 504 to form a rectangle. Gusset 505 is inserted between the flanges of beams 501, 502 and 503, and gusset 506 is inserted between the flanges of beams 501, 503 and 504. End jointed beam sections 507 and 508 are formed as in the embodiment of FIG. 14 with a length equal to that of beams 502 and 504 and slits cut in each end to fit over the flanges of beams 501 and 503. The flanges of each beam section are fitted over the exposed edge of corresponding gusset 505 or 506. Fasteners are driven through the flanges of the jointed beam sections, the end joints of beam sections 507 and 508 and through the flanges of the beams 501, 503 and the corresponding gusset.

Figure 14:
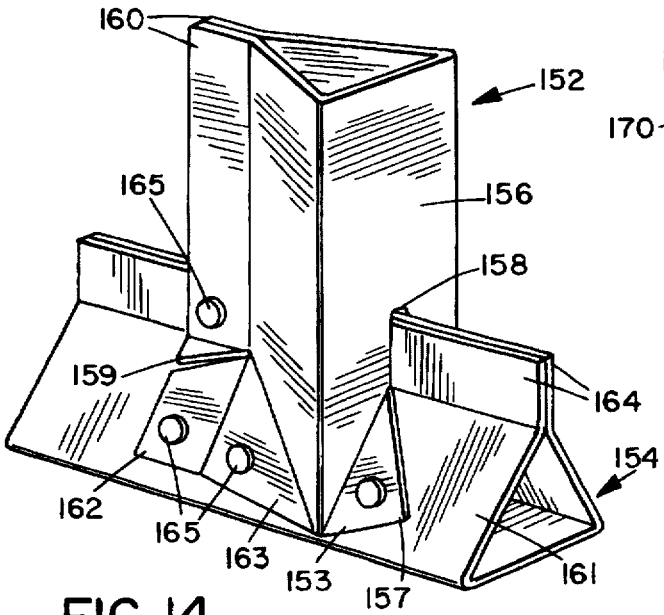
FIG. 14 is a perspective view of a first joint for joining one beam to another in a perpendicular arrangement.

The struts which make up the open web of the shear panel are formed by combining beam sections with end joints 514–521 formed as in the embodiment of FIG. 14 with slits at each end to fit over the beam flanges, and gussets 522–525, with two brackets per gusset so that the gusset is sandwiched between the flanges of two beam sections. The struts 510–513 are disposed at angles less than 90 degrees to the beams 501, 503 so that the web has a zig-zag configuration. The angles are selected to provide uniform shear resistance between the first beams 501, 503 and to provide the desired degree of overall shear resistance. The ends of the brackets of each web section are fastened to the flanges of beams 501 and 503 using press joints, rivets, sheet metal screws or other appropriate fastening means. The dimensions of the beams and beam sections in the struts can be different from each other. To provide an example, the beams 501–504 can be made from 16 gauge steel with triangle dimensions of 2"×2"×2", while the beam sections 514–521 can be 18 gauge steel with dimensions of 1.5"×1.5"×1.5". The gussets 505, 506, 522–525 can also be made from 18 gauge steel. As will be apparent to those skilled in the art, the thickness and grade of the steel can vary depending on the purpose of the structure, e.g., light commercial, residential, etc., and on environmental factors which determine shear resistance requirements. The preferred material has structural properties designated as ASTM-A446/D, regardless of thickness.

The following connection means may be used in all embodiments of the invention as appropriate according to the foregoing descriptions:

The connector or end joint illustrated in FIG. 7 provides means for directly attaching a triangle cross-section beam to a wood stud (or other construction material). The triangular portion 63 can be either a beam itself, or a connector which telescopes with a beam. In either case, the triangular portion 63 is formed in the same manner as the beam of FIG. 1. Near the end of the beam, a section of the triangle is cut away by making a lengthwise cut along each of the lower corners 65 of the triangle, leaving only the base of the triangle. This creates an extension 64 which is generally flat (except for the slight curvature at the edges 66 corresponding to the lower corners of the triangle). For fitting over a 2×4 stud, the end of extension 64 may be bent upward to create a space of 2 inches between the location of the cut 66 and the upwardly bent end 68, or the extension can simply be left straight. The 2×4 stud is then abutted against the extension 64, the edges 66 of the triangle and the upwardly front end 68, if used. Fasteners such as nails or wood screws are then used to attach the beam to the horizontal member. The extension 64 provides additional support and stability for a composite structure made of beams and other construction material, such as, in this example, wood studs. Where the beam of FIG. 11 is used as the vertically running stud, each triangular beam section 450, 452 can be modified to create extensions for essentially wrapping around the horizontal member to which it is to be attached.

Figure 6:
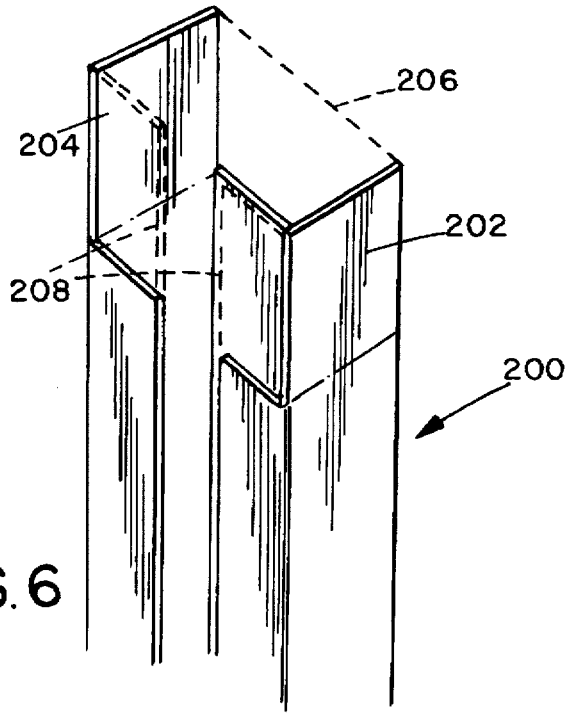

A similar extension tab can be formed in the end of a C-channel beam or other multi-sided metal beam by cutting inward along the length of the beam for a distance corresponding to the desired length of the extension tab. As illustrated in FIG. 6, a C-channel beam 200 with extension tabs 202, 204 is formed by cutting away sections 206, 208 (shown as dashed lines). The lengths of the extension tabs 202, 204 are preferably long enough to wrap around the horizontal beam to which the C-channel stud is to be attached, similar to the extension tabs illustrated in FIG. 10.

Figure 10A:
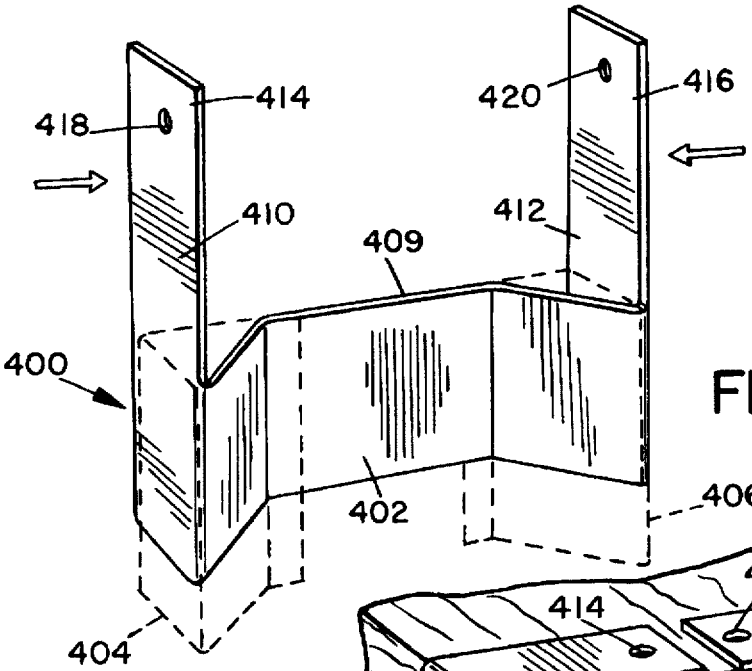
FIGS. 10*a* and *b* are an alternate connector for attaching a pair of triangular beams to a wood stud, with FIG. 10*a* showing the connector alone and 10*b* showing the connector with a wood stud.
Figure 10B:
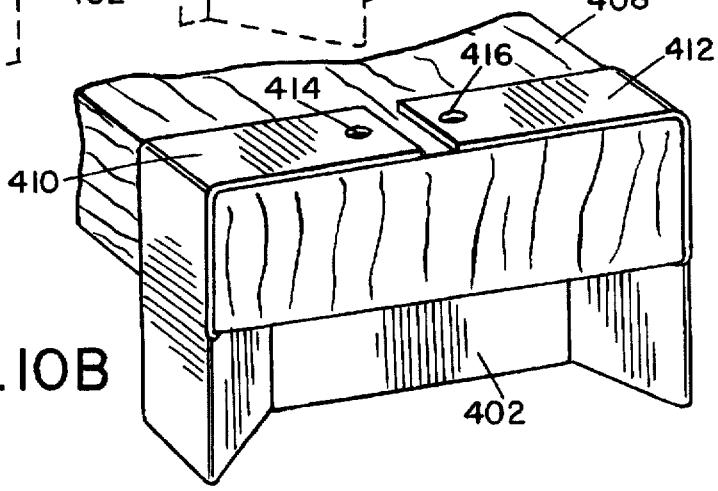

A second means for attaching a pair of triangular beams to a wood stud, or similarly dimensioned material, is illustrated in FIGS. 10*a* and *b*. This type of connector may also be used to attach vertical beams to a 2×4 header. A separate connector 400 has two sections—a first section 402 which is bent to create partial triangular profiles for fitting over a portions of the exterior of each of beams 404 and 406 (shown with dashed lines in FIG. 10*a*). Fasteners may be driven through the flanges of the respective beams and through the first section 402. The wood stud 408 (shown in FIG. 10*b*) to which the beams are to be attached is butted against the inside end 409 of the first section 402, between arms 410, 412. The dimensions of the connector 400 are such that it closely fits the wood header dimensions, e.g., 4 inches between the arms for a 2×4 header. With the stud 408 in place, arms 410, 412 are bent to wrap around the header, with ends 414, 416 contacting the side of the header opposite that abutting the first section 402. Holes 418, 420 may be pre-drilled or pre-cut to facilitate attachment to the header 408 by driving nails, screws, or other appropriate fasteners through the holes and into the wood.

Figure 13:
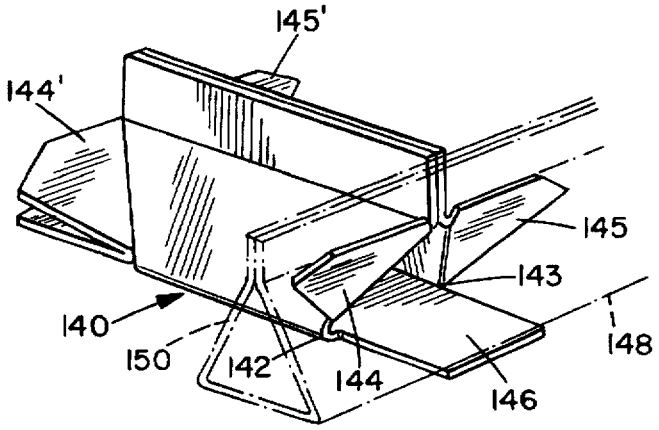
FIG. 13 is a perspective view of a connector for joining two beams in a parallel arrangement.

The end joint 140 illustrated in FIG. 13 may be a separate connecting piece or may be a modified end of a full beam which allows one beam to be directly attached perpendicular to a second beam. Here, it is shown as a separate connecting piece, but for purposes of the shear panel struts, the beam sections themselves have the end joints formed directly therein. End joint 14 is of the same construction as is the basic beam (as in FIG. 1 ). Lengthwise cuts are made along the lower corners 142, 143 of the triangle and the wing portions above the triangle are removed. The side flaps 144, 145 are bent away from the extended base 146 at the same angle as the side of a beam. Here, beam 148, shown in dotted lines, illustrates the relationship between the bent-back side flaps and the side of the beam to which the end joint 140 attaches. Extended base 146 supports the bottom (base) of beam 148, while the side flaps 144 and 145 contact the side 150 of the beam 148. Fasteners (not shown) may be driven through the base 146 and the side flaps 144 and 145 into beam 148 to firmly attach the end joint 140 perpendicular to the side of the beam 148. At the opposite end of the end joint 140, no beam is shown, but the flaps 144' and 145' and base extension 146 are ready to be attached to another beam which will then be parallel to beam 148.

The end joint shown in FIG. 14 may be formed either in a separate connector or at the end of a beam, similar to the end joint of FIG. 13. Here, the joint is shown formed at the end of beam 152 which is to be attached perpendicular to beam 154, however by simply changing the bend angles, joints other than perpendicular can be created. To form the joint, a basic beam is cut with a lengthwise cut 158 into the center of the base 156 for a distance approximately equal to the height of beam 154. Adjacent the lower part of the cut, the corners 157 are bent away from the base 156 to create a triangular opening corresponding to the cross-section of beam 154, with flaps 153 abutting sides 161 of beam 154.

A second cut 159 is made laterally across both flanges 160 and the lower corners 162 are bent outward to create a triangular opening corresponding to the cross-section of beam 154 with flaps 163 abutting sides 161 of beam 154. The beam 152 is fitted down over beam 154 making sure that the flanges 164 are fully seated within cut 158. Fasteners 165 may be driven through the flaps 153 and 163 and into sides 161.

Figure 15:
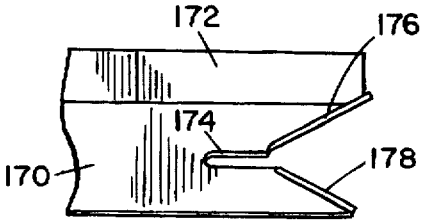
FIG. 15 is a side elevation of a second joint for joining one beam to another in a perpendicular arrangement.
Figure 16:
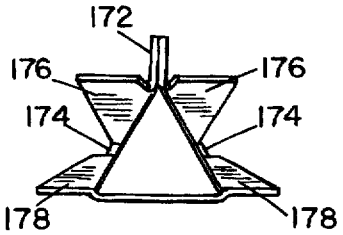
FIG. 16 is an end view of the second joint.

FIGS. 15 and 16 illustrate an alternate joint for attaching the end of one beam to the top of another. This joint differs from that of FIG. 14 in that the flanges of the two beams do not meet. Instead, the flanges of the beam to which the beam 170 is to be joined are inserted into slots 174. Slots 174 are formed by cutting lengthwise in from the beam end into sides 170 and bending the corners of the slots 174 back to create flaps 176 and 178. The flaps 176 and 178 are bent back to create a triangular opening with dimensions corresponding to the triangular cross-section of a basic beam, such as shown in FIG. 1. Once the joint is fitted over the beam to which beam 170 is to be attached, fasteners (not shown) may be driven through flaps 176 and 178 into the sides of the adjoining beam to provide a strong connection between the beams.

Figure 17A:
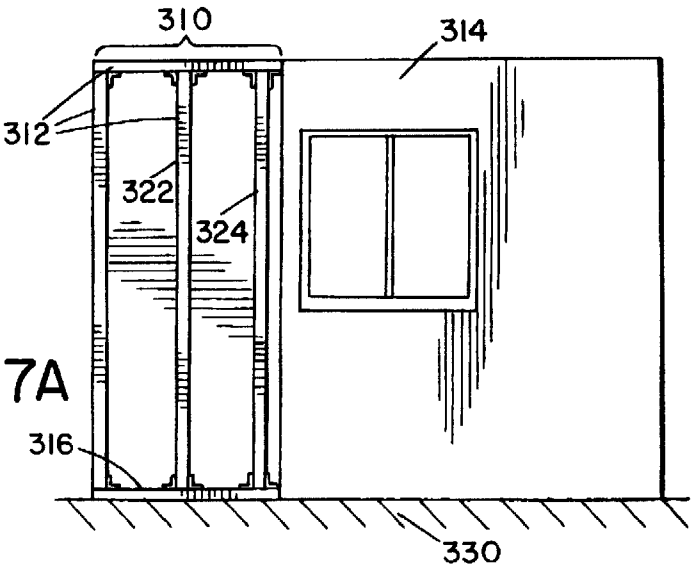
FIGS. 17*a–d* illustrate a sequence for reinforcing an existing structure using a horizontally oriented version of the first embodiment of the shear resisting means, with FIG. 17*a* showing the interior paneling removed to expose the frame, FIG. 17*b* showing the placement of optional temporary support means, FIG. 17*c* showing the wall section with the original wall studs removed, and FIG. 17*d* showing the shear resisting means within the wall.
Figure 17B:
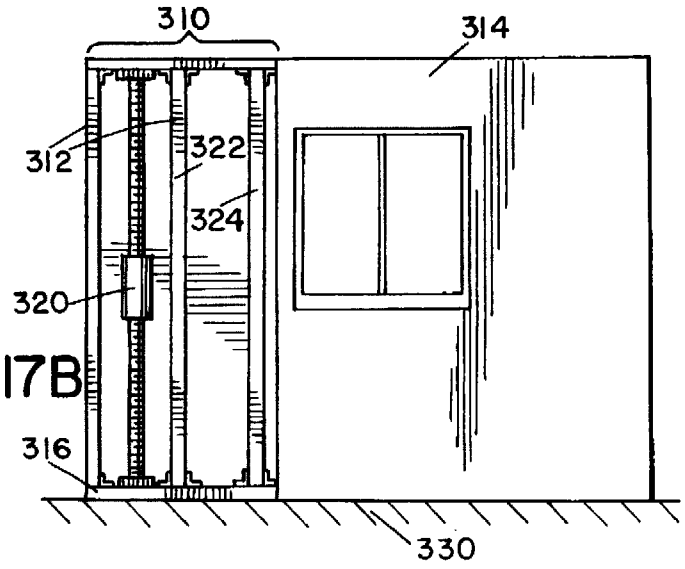
Figure 17C:
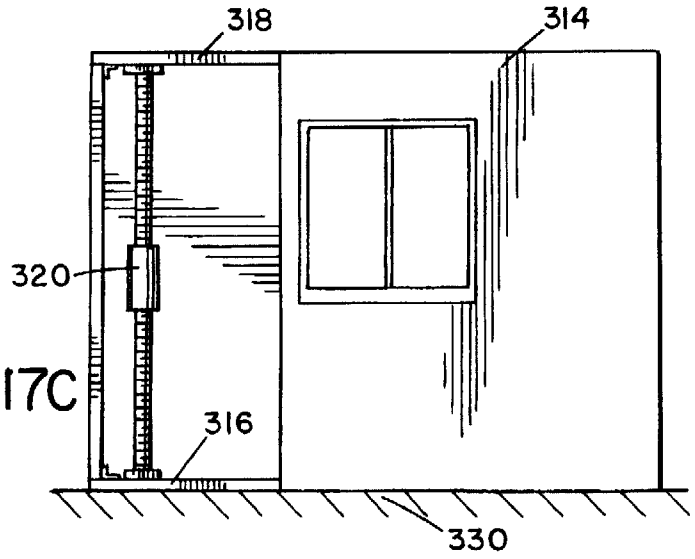
Figure 17D:
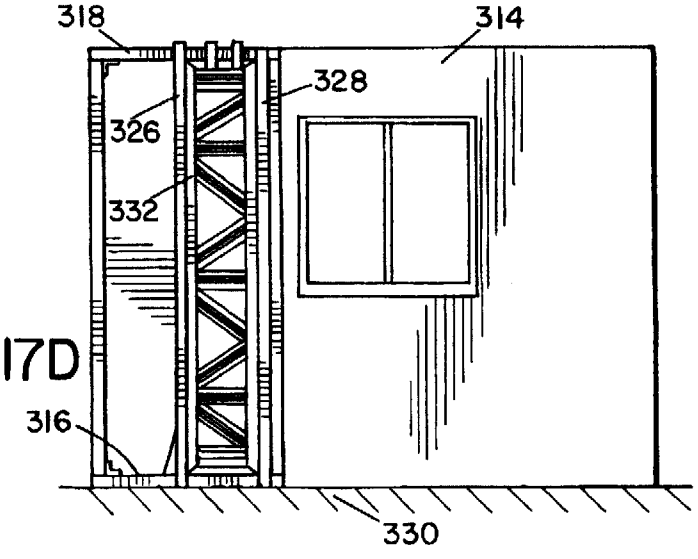

The method for installing the shear panels into an existing structure to enhance shear resistance comprises identification of load bearing walls and the most critical location of vulnerability to shear force with those walls, which is known in the construction art. After identification of the desired location(s), indicated as section 310 in FIGS. 17*a–d*, sections of the dry wall 314, or other interior paneling, is removed to expose the interior portion of the existing frame structure 312 for the entire height of the wall (floor to ceiling). In damaged structures, support may be required in order to remove the existing stud safely and without further settling or shifting. A method for providing temporary support to the wall uses removable stud members or a jack 320 at an adjacent, but non-interfering location, as illustrated, after which the existing wall studs 322, 324 are removed, as shown in FIG. 17*c*. In undamaged structures, the minimal amount of intrusion involved in installing the panel does not require any temporary support means. The replacement studs 326, 328 which are already attached to the shear panel 332 are put into the places of the removed wall studs and firmly attached to the foundation 330 and/or lower horizontal member 316 and the ceiling header 318, as disclosed above. If used, the jack 320 is then removed. The dry wall panel is then replaced over section 310 and attached to the replacement studs. After the edges of the dry wall panel are finished, the modified area will appear as it did prior to the installation.

While FIGS. 17*a–d* illustrate a single standard spacing between two adjacent wall studs which is being replaced, the shear panel can span more than one standard stud spacing, e.g., 16 inches. A 32 inch panel with studs disposed at each side, such as the panel illustrated in FIG. 2, can be used to replace three existing studs, however, it may be desirable to install a third beam at the lengthwise center of the shear panel to provide a fascia for attaching drywall or the surface paneling. As previously described, the third center beam 13, which is indicated with dashed lines, is not weight-bearing or critical to the integrity of the shear panel, but merely assures that the standardized spacing between attachment surfaces for paneling is preserved.

The present invention provides a fully compatible and cost-effective means for reinforcing new structures and retro-fitting existing structures, damaged or undamaged, against external shear forces. The inventive methods provide the least intrusive means for installing superior shear resistance, all of which can be performed from the inside of the structure without the substantial exterior repair required to restore the structure's integrity. This is a significant advantage in view of the ease of restoring interior paneling to its original appearance as compared with dealing with refinishing of shingles, stucco, siding or other exterior finish of the structure.

Further, the inventive method provides an independent attachment to the strongest feature of the siding—its foundation. It does not rely on the framing to support the reinforcement as do nearly all existing shear reinforcement methods.

It will be evident that there are additional embodiments which are not illustrated above but which are clearly within the scope and spirit of the present invention. The above description and drawings are therefore intended to be exemplary only and the scope of the invention is to be limited solely by the appended claims.

We claim:

1. A structural shear resisting member for installation in a wall frame wherein said wall frame includes a plurality of wall studs and a plurality of horizontal members, the shear resisting member comprising:

a frame formed from four lightweight metal beams, each beam of said four beams having a first triangular cross-section formed by folding a length of sheet metal lengthwise on four parallel lines to define a base, two sides and two flanges extending from said two sides, one flange corresponding to each side, said four beams comprising two first beams having a first beam length, and two second beams having a second beam length much less than said first beam length;

a plurality of gussets for connecting said first beams and said second beams to assemble said frame, each gusset being fastened to said flanges of said first beams and one of said second beams at a plurality of gusset attachment points, each gusset comprising a strip of sheet metal having a length for spanning a space between said first beams;

a plurality of strut members for spanning said space between said first beams at a plurality of different angles, each strut member of said plurality being fastened to said flanges of at least one of said first beams at a strut attachment point, each strut member including a strip of sheet metal having a plurality of lengthwise folds to define a second triangular cross-section;

a plurality of first fastening means for fastening said plurality of gussets and said plurality of strut members to said flanges of said first and second beams; and means for attaching said frame within said spacing between two wall studs of said plurality of wall studs and to an upper and a lower horizontal member of said plurality of horizontal members.

2. A structural shear resisting member as in claim 1 further comprising two replacement wall studs, each replacement wall stud having an upper end and a lower end and having a length corresponding to a distance between the upper and lower horizontal members, said replacement wall stud having a plurality of extension tabs extending from each of said upper and lower ends, wherein said means for attaching said frame comprises second fastening means for fastening one said replacement wall stud to each said first beam and third fastening means for fastening said plurality of extension tabs to said upper and lower horizontal members.

3. A structural shear resisting member as in claim 2 wherein said replacement wall stud is a C-channel beam.

4. A structural shear resisting member as in claim 2 wherein said replacement wall stud comprises two triangular cross-section beams joined by a plurality of second gussets to form an open web beam having dimensions substantially equal to one of said wall studs of said wall frame.

5. A structural shear resisting member as in claim 1 wherein each said gusset has a plurality of lengthwise folds formed therein to create a triangular cross-section ridge.

6. A structural shear resisting member as in claim 1 wherein said second beam length is adapted to be less than said spacing between two wall studs of said plurality of wall studs so that said frame fits within said spacing.

7. A structural shear resisting member as in claim 1 wherein each strut member comprises a pair of triangular beam sections disposed along each lengthwise side of a second gusset and fastened thereto, each of said triangular beam sections having an end joint formed at each end for abutting said flanges of said first beams.

8. A structural shear resisting member as in claim 1 wherein two said strut members are attached at each strut attachment point along said first beams so that said two strut members sandwich said flanges of said first beams.

9. A structural shear resisting member as in claim 1 wherein two said gussets are attached at each gusset attachment point along said first beams and said second beam so that said two gussets sandwich said flanges of said first and second beams.

10. A structural shear resisting member as in claim 1 wherein said fastening means comprise press joints.

11. A method for reinforcing a structural frame wall against external shear forces, said frame wall comprising a plurality of wall studs and a plurality of horizontal members, the method comprising:

identifying a load-bearing position within said frame wall;

forming a shear resisting member comprising the steps of:

forming a frame from four lightweight metal beams, each beam of said four beams having a first triangular cross-section formed by folding a length of sheet metal lengthwise on four parallel lines to define a base, two sides and two flanges extending from said two sides, one flange corresponding to each side, said four beams comprising two first beams having a first beam length, and two second beams having a second beam length much less than said first beam length;

connecting said first beams and said second beams using a plurality of gussets to assemble said frame, each gusset being fastened to said flanges of said first beams and one of said second beams at a plurality of gusset attachment points, each gusset comprising a strip of sheet metal having a length for spanning a space between said first beams;

spanning said space between said first beams at a plurality of different angles using a plurality of strut members, each strut member of said plurality being fastened to said flanges of each of said first beams at a strut attachment point, each strut member including a strip of sheet metal having a plurality of lengthwise folds to define a second triangular cross-section;

fastening said plurality of gussets and said plurality of strut members to said flanges of said first and second beams using a plurality of fastening means;

attaching each said first beam to a metal wall stud;

forming at least one attachment means at each end of said metal wall stud; and fastening said at least one attachment means of each said metal wall stud at said upper and lower horizontal members.

12. The method of claim 11 wherein the step of attaching each said first beam to a metal wall stud includes the step of providing two triangular cross-section beams joined by a plurality of second gussets to form an open web beam having dimensions substantially equal to one of said wall studs of said frame wall.

13. The method of claim 11 wherein the step of attaching each said first beam to a metal wall stud includes the step of providing a C-channel beam.

14. The method of claim 11 wherein said lower horizontal member is supported on a foundation, and the step of fastening said at least one attachment means further includes driving at least one bolt through said at least one attachment means at said lower horizontal member and into said foundation.

15. A method for interiorly retrofitting an existing structural frame to reinforce said structural frame against external shear forces, the method comprising:

identifying a load-bearing position within a wall of said structural frame;

removing an interior wall panel from said wall to expose a portion of said structural frame corresponding to the load-bearing position;

removing at least two wall studs from said structural frame to define a space for installation of a shear resisting member;

forming a shear resisting member comprising the steps of:

forming a frame from four lightweight metal beams, each beam of said four beams having a first triangular cross-section formed by folding a length of sheet metal lengthwise on four parallel lines to define a base, two sides and two flanges extending from said two sides, one flange corresponding to each side, said four beams comprising two first beams having a first beam length, and two second beams having a second beam length much less than said first beam length;

connecting said first beams and said second beams using a plurality of gussets to assemble said frame, each gusset being fastened to said flanges of said first beams and one of said second beams at a plurality of gusset attachment points, each gusset comprising a strip of sheet metal having a length for spanning a space between said first beams;

spanning said space between said first beams at a plurality of different angles using a plurality of strut members, each strut member of said plurality being fastened to said flanges of each of said first beams at a strut attachment point, each strut member including a strip of sheet metal having a plurality of lengthwise folds to define a second triangular cross-section;

fastening said plurality of gussets and said plurality of strut members to said flanges of said first and second beams using a plurality of fastening means;

attaching each said first beam to a replacement metal wall stud;

forming at least one attachment means at each end of said replacement metal wall stud;

fastening said at least one attachment means of each said replacement metal wall stud at said upper and lower horizontal members; and replacing said interior wall panel over said shear resisting member and said replacement metal wall studs.

16. The method of claim 15 wherein the step of attaching each said first beam to a replacement metal wall stud includes the step of providing two triangular cross-section-beams joined by a plurality of second gussets to form an open web beam having dimensions substantially equal to one of said wall studs of said frame wall.

17. The method of claim 15 wherein the step of attaching each said first beam to a replacement metal wall stud includes the step of providing a C-channel beam.

18. The method of claim 15 further comprising the steps of inserting a temporary support means between said upper and lower horizontal members at a non-interfering location adjacent the load-bearing position before the step of removing at least two wall studs and removing the temporary support means before replacing said interior wall panel.

19. A method for reinforcing a structural frame wall against external shear forces, said frame wall comprising a plurality of wall studs and a plurality of horizontal members, the method comprising:

identifying a load-bearing position within said frame wall;

forming a shear resisting member comprising the steps of:

forming a frame from four beams, said four beams comprising two first beams having a first beam length, and two second beams having a second beam length much less than said first beam length, said second beam length defining a space between said two first beams;

spanning said space between said first beams at a plurality of different angles using a plurality of strut members, each strut member of said plurality being fastened to each of said first beams at a strut attachment point;

fastening said plurality of strut members to said first and second beams using a plurality of fastening means;

attaching each said first beam of said frame to a metal wall stud having at least one attachment means at each end of said metal wall stud; and fastening said at least one attachment means of each said metal wall stud at upper and lower horizontal members of said frame wall.

20. The method of claim 19 wherein each metal wall stud has at least a partially hollow cross-section and said at least one attachment means comprises a tab formed at an end of each metal wall stud adjacent to the at least one partially hollow cross-section so that said tab extends to abut and for attachment to at least one of said upper and lower horizontal members of said frame wall.

21. The method of claim 19 wherein said lower horizontal member is supported on a foundation, and the step of fastening said at least one attachment means further includes driving at least one bolt through said at least one attachment means at said lower horizontal member and into said foundation.

22. A method for interiorly retrofitting an existing structural frame to reinforce said structural frame against external shear forces wherein said structural frame supports a plurality of interior wall panels, the method comprising:

identifying a load-bearing position within a wall of said structural frame;

removing an interior wall panel of said plurality of interior wall panels from said wall to expose a portion of said structural frame corresponding to the load-bearing position;

removing at least two wall studs from said structural frame to define a space for installation of a shear resisting member;

forming a shear resisting member comprising the steps of:

forming a frame from four metal beams, each beam of said four beams having a first hollow cross-section formed by folding a length of sheet metal lengthwise on four parallel lines, said four beams comprising two first beams having a first beam length, and two second beams having a second beam length much less than said first beam length, said second beam length defining a space between said two first beams;

spanning said space between said first beams at a plurality of different angles using a plurality of strut members, each strut member of said plurality being fastened to each of said first beams at a strut attachment point, each strut member including a strip of sheet metal having a plurality of lengthwise folds to define a second hollow cross-section;

fastening said plurality of strut members to said first and second beams using a plurality of fastening means;

attaching each said first-beam to a replacement metal wall stud having at least one attachment means at each end;

fastening said at least one attachment means of each said replacement metal wall stud at upper and lower horizontal members; and replacing said interior wall panel over said shear resisting member and said replacement metal wall studs.

23. The method of claim 22 wherein each replacement metal wall stud has at least a partially hollow cross-section and said at least one attachment means comprises a tab formed at an end of each replacement metal wall stud adjacent to the at least one partially hollow cross-section so that said tab extends to abut and for attachment to at least one of said upper and lower horizontal members of said frame wall.

24. The method of claim 23 wherein the at least partially hollow cross-section of each replacement metal wall stud includes two triangular cross-sections, each triangular cross-section having a base, wherein said tab is an extension of said base having a length greater than a thickness of at least one of said upper and lower horizontal members so that said tabs can be at least partially wrapped around the at least one of said upper and lower horizontal members.

25. The method of claim 23 wherein each replacement metal wall stud is a C-channel beam having two opposing sides, wherein said tab is an extension of each of said opposing sides having a length greater than a thickness of at least one of said upper and lower horizontal members so that said tab can be at least partially wrapped around the at least one of said upper and lower horizontal members.

26. The method of claim 22 further comprising the steps of inserting a temporary support means between said upper and lower horizontal members at a non-interfering location adjacent the load-bearing position before the step of removing at least two wall studs and removing the temporary support means before replacing said interior wall panel.

27. A method for interiorly retrofitting an existing structural frame for supporting a plurality of interior and exterior wall panels to reinforce said structural frame against external shear forces, the method comprising:

identifying a load-bearing position within a wall of said structural frame;

removing an interior wall panel of said plurality of interior and exterior wall panels from said wall to expose a portion of said structural frame corresponding to the load-bearing position;

removing at least two wall studs from said structural frame to define a space for installation of a shear resisting member;

forming a shear resisting member comprising the steps of:

forming a frame from four beams comprising two first beams having a first beam length, and two second beams having a second beam length much less than said first beam length, said second beam length defining a space between said two first beams;

spanning said space between said first beams at a plurality of different angles using a plurality of strut members, each strut member of said plurality being fastened to each of said first beams at a strut attachment point;

fastening said plurality of strut members to said first and second beams using a plurality of fastening means;

attaching each said first beam to a replacement wall stud having at least one attachment means at each end;

fastening said at least one attachment means of each said replacement wall stud at upper and lower horizontal members; and replacing said interior wall panel over said shear resisting member and said replacement wall studs.

28. The method of claim 27 wherein each replacement wall stud comprises a metal beam having at least a partially hollow cross-section and each at least one attachment means comprises a tab formed at an end of said metal beam adjacent to the at least one partially hollow cross-section so that said tab extends to abut and for attachment to at least one of said upper and lower horizontal members of said frame wall.

* * * * *